US005879051A

United States Patent [19]

Cozzani

[11] Patent Number: 5,879,051

[45] Date of Patent: Mar. 9, 1999

[54] DEVICE AND METHOD FOR FIXING A SEAT COVERING AND THE SEAT OBTAINED

[75] Inventor: Henri Cozzani, Conflans St Honorine, France

[73] Assignee: ITW De France, Beauchamp, France

[21] Appl. No.: 960,285

[22] Filed: Oct. 29, 1997

[30] Foreign Application Priority Data

Nov. 14, 1996 [FR] France ..... 96 13886

[51] Int. Cl.[6] ..... A47C 27/00

[52] U.S. Cl. ..... 297/218.3; 297/218.1; 297/218.5

[58] Field of Search ..... 297/218.1, 218.3, 297/218.5

[56] References Cited

U.S. PATENT DOCUMENTS

| | | | |
|---|---|---|---|
| 3,981,534 | 9/1976 | Wilton | 297/218.1 |
| 4,789,201 | 12/1988 | Selbert . | |
| 4,867,507 | 9/1989 | Arai | 297/218.1 |
| 5,015,034 | 5/1991 | Kindig et al. | 297/218.5 X |
| 5,503,454 | 4/1996 | Sakamoto | 297/218.5 X |
| 5,718,478 | 2/1998 | Allison | 297/218.1 X |

FOREIGN PATENT DOCUMENTS

| | | |
|---|---|---|
| 0 372 340 | 11/1989 | European Pat. Off. . |
| 0 606 179 | 1/1994 | European Pat. Off. . |
| 2671704 | 1/1991 | France . |
| 2697873 | 11/1992 | France . |

*Primary Examiner*—Laurie K. Cranmer
*Attorney, Agent, or Firm*—Schwartz & Weinrieb

[57] ABSTRACT

The device comprises a band (9) made of relatively rigid plastic material designed to be sewn to the covering (4) and also hooking means (11) adapted to engage on a predetermined element (2) of the seat (1), the band (9) and the hooking means (11) being manufactured in a single piece from the same material.

The seat (1) comprises in particular as the predetermined element (2) an end portion (6) in the form of a corner.

The method provides for a sewing step in which the covering (4) is sewn on the fixing device (5) on the same side as the hook (13), the device (5) then being turned relative to the covering (4) so that its side opposite to the hook (13) is against the covering before clipping on the end portion (6).

33 Claims, 2 Drawing Sheets

DEVICE AND METHOD FOR FIXING A SEAT COVERING AND THE SEAT OBTAINED

FIELD OF THE INVENTION

The invention relates generally to the fixing of seat coverings, and in particular, to the fixing of coverings of vehicle seats.

BACKGROUND OF THE INVENTION

Devices for fixing seat coverings are already known, in particular from FR-A-2.671.704 and FR-A-2.697.873, which comprise a band of plastic material adapted to be sewn to an edge of the covering, and hooking means, comprising a flexible element, which serve to fasten the band to a predetermined element of the seat on which they may engage.

OBJECT OF THE INVENTION

The invention aims to make it possible to effect the fixing of the covering on the seat in a simpler, more convenient and less expensive manner.

SUMMARY OF THE INVENTION

For this purpose it provides a device for fixing a seat covering comprising a band made of relatively rigid plastic material adapted to be sewn to the covering and hooking means adapted to be engaged on a predetermined element of the seat, characterized in that the band and the hooking means are manufactured in a single piece from the same material.

The fixing device being made as a complete unit from the same relatively rigid plastic material, the engagement of the hooking means is easy to perform blind because it is possible to control the positioning by means of the band sewn to the covering.

It will be noted that in contrast, in the case of the earlier fixing devices mentioned above, the presence of the flexible element between the band and the part which engages on the seat makes blind mounting much more difficult, because it is necessary for the operator to directly manipulate, without seeing it, the part which engages on the seat.

Moreover, manufacturing of the device according to the invention is much simpler because there is no need to join materials of different types.

In a preferred embodiment of the device according to the invention, the hooking means are adapted to cooperate by clipping onto the predetermined element of the seat.

The resiliency possibly necessary to move the fixing device further than the final retaining position so that it can clip on during its return travel to the final position, is provided if necessary, for example, by the seat covering and/or by the upholstery of the latter, and not by the flexible element as in the case of the fixing device known from FR-A-2.697.873.

In the preferred embodiment, the invention also benefits from the advantages of clipping on, that is to say, in particular, from retention in the engagement position at the cost of a simple positioning manipulation of the hooking means relative to the predetermined element of the seat.

In accordance with preferred characterizing features of the embodiment, for reasons of simplicity and convenience, both with regard to manufacture and use, the hooking means comprise a flange and a hook adapted to co-operate with an end portion in the form of a corner of the predetermined element.

Preferably, for practical implementation reasons, the flange and the hook are designed so that the end portion in the form of a corner comprises an intermediate arm and a terminal arm connected transversely to the intermediate arm, with the intermediate arm extending between the terminal arm and the remainder of the predetermined element and the terminal arm extending between the intermediate arm and the end of the end portion:

the flange comprises a bearing surface, called a first bearing surface, for bearing against the surface of the intermediate arm situated on the convex side of the end portion, called a first surface of the end portion;

the hook affords:

a bearing surface, called a second bearing surface, which is joined transversely to the first bearing surface, for bearing against the surface of the terminal arm which is on the convex side of the end portion, called a second surface of the end portion, the second bearing surface and the second surface of the end portion having the same width;

a bearing surface, called a third bearing surface, which is connected transversely to the second bearing surface and which is located facing the first bearing surface, for bearing against the surface situated at the end of the end portion, called a third surface of the end portion, the third bearing surface and the third surface of the end portion having the same width, and a bearing surface, called a fourth bearing surface, which is connected transversely to the third bearing surface and which is located facing the second bearing surface, for bearing against the surface of the terminal arm which is on the concave side of the end portion, called a fourth surface of the end portion, the fourth bearing surface being narrower than the fourth surface of the end portion, and the hook is resiliently deformable so to allow the distance between the first surface and the edge of the fourth surface which is closest to it to assume the width of the second surface of the end portion as a result of an appropriate driving force of the hook.

This driving force is advantageously obtained by arranging that the hook also comprises a ramp which is connected to the fourth bearing surface and is located facing the first bearing surface, the ramp comprising a sloping surface disposed at an acute angle relative to the fourth bearing surface in such a manner that the fixing device and the end portion are set into motion relative to one another by the first bearing surface of the fixing device which moves against the first surface of the end portion in the direction in which the hook of the device approaches the terminal arm of the end portion, the terminal arm finally encounters the ramp of the hook, and the latter then changes shape so as to allow the distance between the first surface and the edge of the fourth surface which is closest to it to assume the width of the second surface of the end portion, and once the terminal arm has passed over the ramp, the hook resumes its shape so that the fourth bearing surface of the fixing device faces the fourth surface of the end portion.

Preferably, also, the band and the flange which comprise the hooking means are coplanar.

These characteristics are advantageous, notably for manufacturing simplicity reasons and for inconspicuousness of the fixing device.

In particular it is possible to arrange that the band extends in the opposite direction to the flange from the place where the hook is joined to it.

This makes it possible, as will be seen later, to have a relative positioning of the seat covering and its fixing device which enables the covering to completely conceal the fixing device and to co-operate with the end portion in the form of a corner under the best conditions.

A second aspect of the invention is that it also aims to provide a seat characterized in that it comprises a fixing device such as is described above, a framework, upholstery carried by the framework, and a covering to cover the upholstery, the covering being sewn on the band of the fixing device and the hooking means of the fixing device being engaged on the framework.

In the case where the fixing device is in accordance with the preferred characteristics referred to above, the end portion in the form of a corner advantageously forms part of the framework of the seat.

In the case where the fixing device is in accordance with the characteristics referred to above, according to which the band extends in the opposite direction to the flange from the place where the hook is joined to it, the intermediate arm of the end portion preferably extends transversely and in the opposite direction to the upholstery of the seat whereas the terminal arm extends towards the interior of the seat.

The invention also envisages a method of fixing the covering of a seat as described in the latter case, the method being characterized in that it comprises:

- a sewing step in which the edge of the covering is sewn on the band of the fixing device on the side on which the hook is located, and
- a step, preceding the step of clipping the fixing device on the end portion, in which the opposite side of the fixing device to its hook is brought against the covering.

BRIEF DESCRIPTION OF THE DRAWINGS

The invention will now be explained in more detail in the following description of embodiment examples, given by way of non-limiting examples and with reference to the attached drawings, in which like reference characters designate like or corresponding parts throughout the several view, and wherein.

DETAILED DESCRIPTION OF THE ILLUSTRATED EMBODIMENTS

Figure 1:
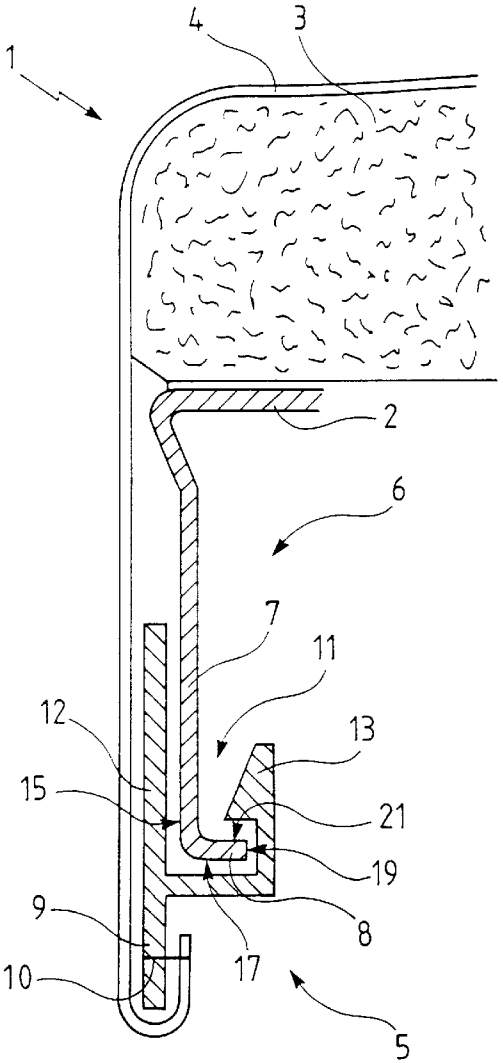
FIG. 1 is a partial frontal view of a cross-section of a seat according to the invention.

The seat 1 shown in FIG. 1 comprises a framework 2, upholstery 3 (here that of the seat itself) carried by the framework 2 and a covering 4 serving to cover the upholstery 3. The covering 4 extends below the upholstery 3 as far as a fixing device 5 clipped on an end portion 6 in the form of a corner of the framework 2.

The end portion 6 comprises an intermediate arm 7 and a terminal arm 8 connected transversely to the arm 7, the latter extending between the arm 8 and the remainder of the framework 2 and the arm 8 extending between the arm 7 and the end of the end portion 6.

The arm 7 extends transversely and in the opposite direction to the upholstery 3 and the arm 8 extends parallel to the upholstery 3, towards the interior of the seat 1.

The fixing device 5 comprises a band 9 connected to the end of the covering 4 by a stitched seam 10 and hooking means 11 for clipping onto the portion 6, the means 11 being formed by a flange 12 and a hook 13.

The band 9 and the flange 12 are both flat and are coplanar, that is to say they extend in the prolongation of one another, the band 9 extending in the opposite direction to the flange 12 from where the hook 13 is connected to it.

In the example shown in FIGS. 1 to 4, the framework 2 is made of sheet metal, the covering 4 is made of cloth and the fixing device 5 is made of a relatively rigid plastic, such as polypropylene, and is made by extrusion.

Figure 3:
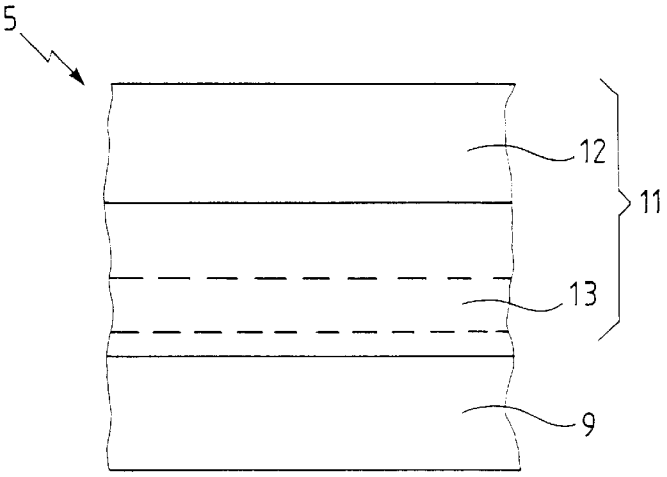
FIG. 3 is a front view from the side seen on the right in FIG. 2.
Figure 2:
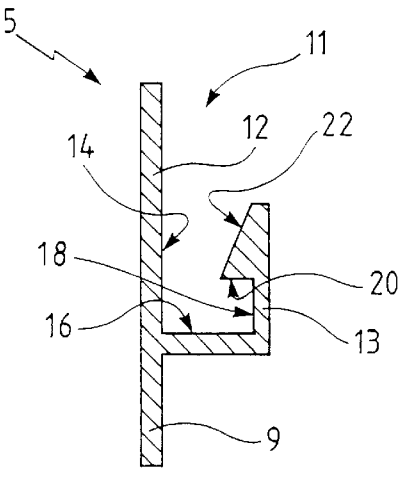
FIG. 2 is a cross-section of the device for fixing the covering of this seat.

As can be seen in FIGS. 1 and 2, the flange 12 has, on the side where the hook 13 is located, a surface 14 against which the surface 15 of the arm 7 which is located on the convex side of the portion 6 bears.

The hook 13 for its part, comprises:

- a surface 16 which is connected transversely to the surface 14, against which the surface 17 of the arm 8 which is on the convex side of the portion 6 bears;
- a surface 18 which is connected transversely to the surface 16 and faces the surface 14, the surface 18 acting to bear against the surface 19 located at the end of the end portion 6;
- a surface 20 which is connected transversely to the surface 18 and faces the surface 16, the surface 20 acting to bear against the surface 21 which is on the concave side of the end portion 6;
- a ramp 22 which is connected to the surface 20 and faces the surface 14, in this case the entire ramp 22 slopes and it forms an acute angle relative to the surface 20.

The surfaces 16 and 17 are of the same width (dimensions are shown in FIGS. 1 and 2, the operating play being very exaggerated for clarity in the Figures), the surfaces 18 and 19 are similarly of the same width and the surface 20 is narrower than the surface 21. The distance between the surface 14 and the edge of the surface 20 to which it is closest (in this case the edge between the surfaces 20 and 22) is less than the width of the surface 17, but the hook 13 is deformable, thanks to the elasticity of the material of which the device 5 is made, so that the distance may correspond to the width during the action of a force on the hook obtained, in particular, thanks to the ramp 22, in order to enable the portion 6 to be clipped on, as explained later.

Figure 4:
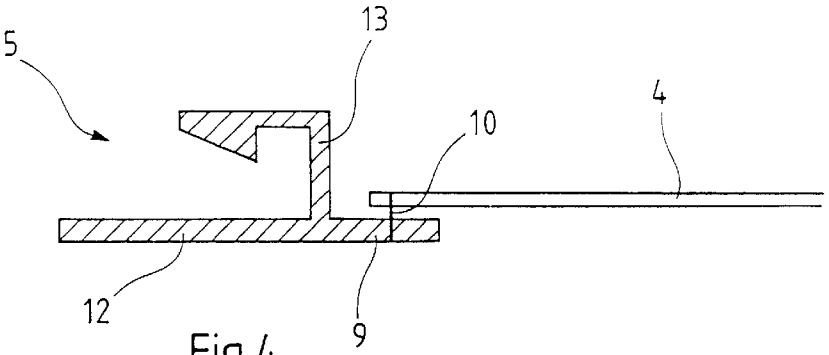
FIG. 4 is a cross-section showing how the seat covering is sewn to the fixing device.

FIG. 4 shows the configuration in which the fixing device 5 and the covering 4 are placed to sew them to one another.

It can be seen that the covering is placed on the side of the device 5 on which the hook 13 is situated, so that the part located near its end is directed parallel to the band 9, in such a manner that the seam 10 may be easily produced.

Before or after the covering 4 is positioned relative to the upholstery 3, the device 5 is pivoted through 90° relative to the covering 4 so that its side opposite to the hook 13 comes to be against the covering 4, as shown in FIG. 1. The device 5 is thus completely concealed by the covering 4.

To effect the clipping onto the end portion 6, the device 5 and the covering 4 are pulled in the direction opposite to the upholstery 3, for example by seizing the covering 4 and the device 5 by pinching the band 9 and the part of the covering 4 which surrounds it, and the hooking means 11 are then placed facing the end portion 6 in such a way that the surface 15 of the arm 7 comes to be against the surface 14 of the flange 12 and the surface 17 is facing the ramp 22. The surface 15 is then slid over the surface 14 by moving the device 5 in the direction in which it comes closer to the upholstery 3, that is to say in the direction in which the ramp 22 approaches the arm 8, finally the latter comes against the ramp 22 so that during the continuation of the movement the hook 13 changes shape increasing the distance separating the surface 14 from the edge between the ramp 22 and the surface 20. The arm 8 then passes completely beyond the ramp 22 and the hook 13 relaxes so that the hooking position shown in FIG. 1 is reached where the hooking means 11 are clipped onto the portion 6.

Figure 5:
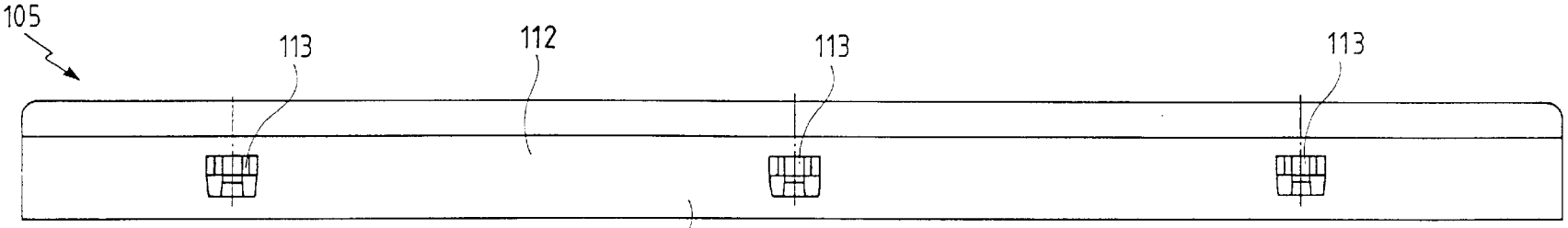
FIG. 5 is a view similar to FIG. 3, but showing in its entirety an alternative embodiment of the fixing device.

The alternative embodiment shown in FIGS. 5 to 7 will now be described. Similar elements are indicated by the same reference numbers increased by the number 100.

The device 105 is similar to the device 5, but is obtained by molding and not be extrusion, three separate hooks 113 being distributed along the flange 112.

The device 105 is made of polyamide or ABS, for example.

Figure 7:
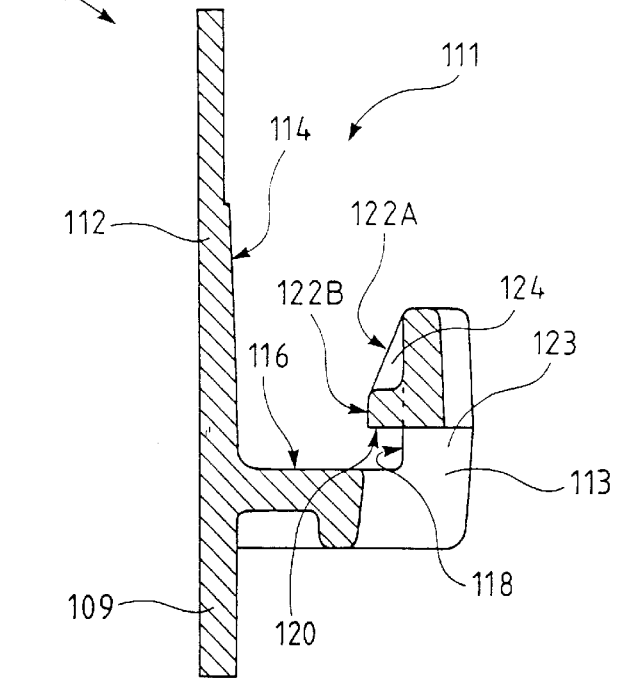
FIG. 7 is an elevation view taken in cross-section along the line 7—7 in FIG. 6.
Figure 6:
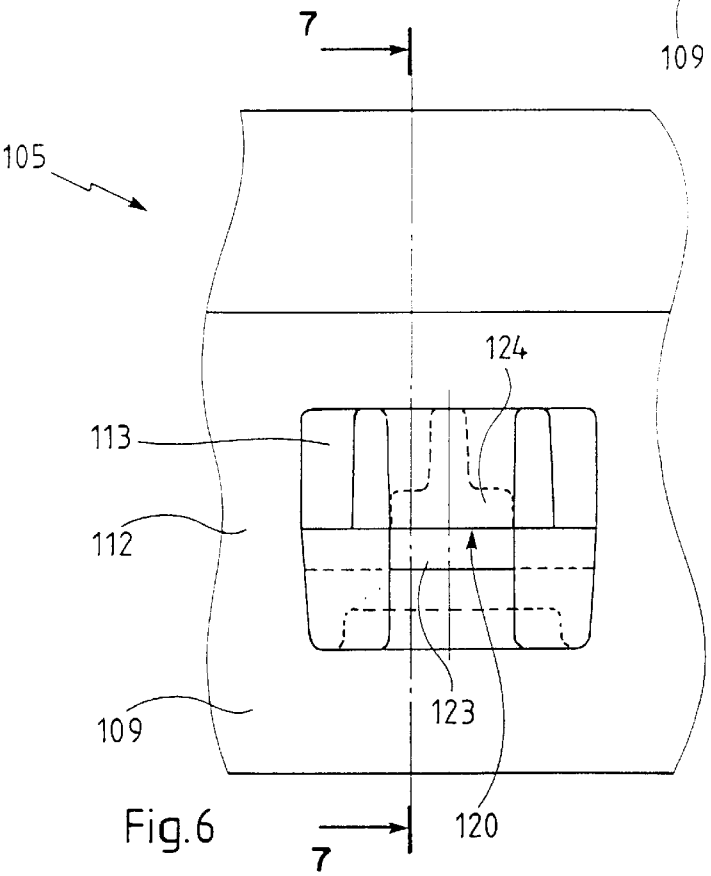
FIG. 6 is an enlargement of a portion of FIG. 5.

FIGS. 6 and 7 show in detail the structure of the hooks 113 which are produced in the same mold as the band 109 and the flange 112.

It will be seen in particular that the surface 120 extends beyond the surface 118, and more generally a passage 123 exists under the surface 120 allowing the withdrawal of a movable core during the molding process.

Similarly, to facilitate removal from the mold, the ramp corresponding to the ramp 22 is provided by means of a thickening 124 in the shape of an inverted T (see FIG. 6) the arm of which furthest from the surface 120 provides a surface 122A sloping like the ramp 22 whereas the other arm forms a surface 122B connected transversely to the surface 120.

In a, not shown, alternative embodiment, the flange 112 exists only near the hooks 113, to reduce the amount of material used. In another, not shown, embodiment, it is not the entire hook 13 or 113 which becomes deformed during clipping on, but only the part which comprises the surfaces such as 20 and 22 or 120 and 122.

Numerous other alternatives are possible depending on the circumstances. In particular, the hooking means 11 or 111 may be replaced by other means adapted to co-operate by clipping to a predetermined element of the seat, or by hooking means engaging in a different manner to clipping on.

More generally,it will be recalled that the invention is not limited to the example s described and shown. It is therefore to be understood that within the scope of the appended claims, the present invention may be practiced otherwise than as specifically described herein.

I claim:

1. A system for fixedly securing a seat covering upon a seat, comprising:

a fixing device comprising a first member having an exterior side, and a second member disposed substantially parallel to and spaced from said first member so as to define a recess between said first and second members, said second member having a first hook engaging portion projecting outwardly therefrom and transversely thereto toward said first member, and said first member having means for fixedly securing the seat covering thereto in such a manner that when the seat covering is secured to first member, said exterior side of said first member is covered by the seat covering and is not visible; and a seat frame member having a first proximal end for fixed mounting upon the seat, and a second distal end disposed away from said first proximal end and comprising a second hook engaging portion for disposition within said recess of said fixing device so as to engage said first hook engaging portion of said second member of said fixing device and thereby permit said fixing device to fix the seat covering upon the seat.

2. The system as set forth in claim 1, wherein:

said seat frame member has a substantially C-shaped configuration wherein said first proximal end of said seat frame member comprises a first upper end of said substantially C-shaped member, said second distal end of said seat frame member comprises a second lower end of said substantially C-shaped member, and an intermediate arm, comprising a web portion of said substantially C-shaped member, interconnects said first and second upper and lower ends of said seat frame member.

3. The system as set forth in claim 2, wherein:

said first and second upper and lower ends of substantially C-shaped seat frame member are disposed transversely with respect to said intermediate arm of said seat frame member so as to be disposed substantially parallel to said transversely extending first hook engaging portion of said fixing device.

4. The system as set forth in claim 3, wherein:

a lower portion of said intermediate arm of said seat frame member is interposed between said first and second substantially planar members of said fixing device when said second hook engaging portion of said seat frame member is disposed within said recess of said fixing device and engaged with said first hook engaging portion of said fixing device.

5. The system as set forth in claim 4, wherein:

said first substantially planar member of said fixing device comprises a first bearing surface for engaging a first surface of said intermediate arm of said seat frame member when said second hook engaging portion of said seat frame member is disposed within said recess of said fixing device and engaged with said first hook engaging portion of said fixing device;

said fixing device further comprises a transversely disposed member, interconnecting said first and second members, defining a second bearing surface for engaging a first surface of said second distal end of said seat frame member, comprising said second hook engaging portion, when said second hook engaging portion of said seat frame member is disposed within recess of said fixing device and engaged with said first hook engaging portion of said fixing device;

said second substantially planar member of said fixing device comprises a third bearing surface, disposed opposite said first bearing surface of said first substantially planar member of said fixing device, for engaging a terminal end surface of said second hook engaging portion of said seat frame member when said second hook engaging portion of said seat frame member is disposed within said recess of said fixing device and engaged with said first hook engaging portion of said fixing device; and said first hook engaging portion of said fixing device comprises a fourth bearing surface, disposed opposite said second bearing surface of said transversely disposed member of said fixing device, for engaging a second surface of said second distal end of said seat frame member, comprising said second hook engaging portion, when said second hook engaging portion of said seat frame member is disposed within said recess of said fixing device and engaged with said first hook engaging portion of said fixing device.

6. The system as set forth in claim 5, wherein:

said transversely disposed member of said fixing device is connected to said first member at an intermediate portion thereof so as to define a first section of said first member which has said first bearing surface defined thereon, and a second section of said first member to which the seat covering is secured.

7. The system as set forth in claim 5, wherein:

said first, second, third, and fourth bearing surfaces of said fixing device are integrally connected to each other.

8. The system as set forth in claim 5, wherein:

said second substantially planar member of said fixing device, having said first hook engaging portion disposed thereon, is flexibly mounted upon said transversely disposed member of said fixing device so as to permit said first hook engaging portion of said fixing device to be moved away from said first substantially planar member of said fixing device and thereby permit said second hook engaging portion of said seat frame member to be inserted into said recess of said fixing device.

9. The system as set forth in claim 8, wherein:

said first hook engaging portion of said fixing device comprises a ramp portion for engaging said second hook engaging portion of said seat frame member whereby, as a result of said second hook engaging portion of said seat frame member encountering said ramp portion of said first hook engaging portion of said fixing device, said first hook engaging portion of said fixing device will be biased away from said first substantially planar member of said fixing device.

10. The system as set forth in claim 9, wherein:

said ramp portion comprises a sloped surface disposed opposite said first bearing surface of said first substantially planar member of said fixing device.

11. The system as set forth in claim 1, wherein:

said fixing device has an elongated length; and a plurality of first hook engaging portions are disposed in a longitudinally spaced array along said fixing device.

12. The system as set forth in claim 1, wherein:

said first and second members, and said first hook engaging portion, of said fixing device all have the same predetermined length.

13. In combination, a seat and a seat cover assembly, comprising:

a seat having an upholstery section;

a seat cover for covering said upholstery section of said seat;

a fixing device comprising a first member, having an exterior side adapted to be fixedly secured to said seat cover, and a second member disposed substantially parallel to and spaced from said first member so as to define a recess between said first and second members, said second member having a first hook engaging portion projecting outwardly therefrom and transversely thereto toward said first member;

a seat frame member having a first proximal end fixedly mounted upon said seat, and a second distal end disposed away from said first proximal end and comprising a second hook engaging portion for disposition within said recess of said fixing device so as to engage said first hook engaging portion of said second member of said fixing device and thereby permit fixing device to fix said seat cover upon said seat; and means disposed upon said first member for fixedly securing said seat cover upon said first member in such a manner that when said seat cover is secured to said first member, said exterior side of side first member is covered by said seat cover and is not visible.

14. The combination as set forth in claim 13, wherein:

said means for fixedly securing said seat cover upon said first member comprises a coplanar extended portion of said first member to which a free end portion of said seat cover is secured.

15. The combination as set forth in claim 14, wherein:

said free end portion of said seat cover is sewn to an interior surface portion of said first member of said fixing device such that when said fixing device is engaged upon said seat frame member as a result of engagement of said first and second hook engaging portions of said second member of said fixing device and said seat frame member, said seat cover covers said seat frame member and said fixing device such that said seat frame member and said fixing device are not visible from said exterior side.

16. The combination as set forth in claim 13, wherein:

said seat frame member has a substantially C-shaped configuration wherein said first proximal end of said seat frame member comprises a first upper end of said substantially C-shaped member, said second distal end of said seat frame member comprises a second lower end of said substantially C-shaped member, and an intermediate arm, comprising a web portion of said substantially C-shaped member, interconnects said first and second upper and lower ends of said seat frame member.

17. The combination as set forth in claim 16, wherein;

said first and second upper and lower ends of said substantially C-shaped seat frame member are disposed transversely with respect to said intermediate arm of said seat frame member so as to be disposed substantially parallel to said transversely extending first hook engaging portion of said fixing device.

18. The system as set forth in claim 17, wherein:

a lower portion of said intermediate arm of said seat frame member is interposed between said first and second substantially planar members of said fixing device when said second hook engaging portion of said seat frame member is disposed within said recess of said fixing device and engaged with said first hook engaging portion of said fixing device.

19. The combination as set forth in claim 18, wherein:

said first substantially planar member of said fixing device comprises a first bearing surface for engaging a first surface of said intermediate arm of said seat frame member when said second hook engaging portion of said seat frame member is disposed within said recess of said fixing device and engaged with said first hook engaging portion of said fixing device;

said fixing device further comprises a transversely disposed member, interconnecting said first and second members, defining a second bearing surface for engaging a first surface of said second distal end of said seat frame member, comprising said second hook engaging portion, when said second hook engaging portion of said seat frame member is disposed within said recess of said fixing device and engaged with said first hook engaging portion of said fixing device;

said second substantially planar member of said fixing device comprises a third bearing surface, disposed opposite said first bearing surface of said first substantially planar member of said fixing device, for engaging a terminal end surface of said second hook engaging portion of said seat frame member when said second hook engaging portion of said seat frame member is disposed within said recess of said fixing device and engaged with said first hook engaging portion of said fixing device; and said first hook engaging portion of said fixing device comprises a fourth bearing surface, disposed opposite said second bearing surface of said transversely disposed member of said fixing device, for engaging a second surface of said second distal end of said seat frame member, comprising said second hook engaging portion, when said second hook engaging portion of said seat frame member is disposed within said recess of fixing device and engaged with said first hook engaging portion of said fixing device.

20. The combination as set forth in claim 19, wherein:

said transversely disposed member of said fixing device is connected to said first member at an intermediate portion thereof so as to define a first section of said first member which has said first bearing surface defined thereon, and a second section of said first member to which the seat covering is secured.

21. The combination as set forth in claim 19, wherein:

said first, second, third, and fourth bearing surfaces of said fixing device are integrally connected to each other.

22. The system as set forth in claim 19, wherein:

said second substantially planar member of said fixing device, having said first hook engaging portion disposed thereon, is flexibly mounted upon said transversely disposed member of said fixing device so as to permit said first hook engaging portion of said fixing device to be moved away from said first substantially planar member of said fixing device and thereby permit said second hook engaging portion of said seat frame member to be inserted into said recess of said fixing device.

23. The combination as set forth in claim 22, wherein:

said first hook engaging portion of said fixing device comprises a ramp portion for engaging said second hook engaging portion of said seat frame member whereby, as a result of said second hook engaging portion of said seat frame member encountering said ramp portion of said first hook engaging portion of said fixing device, said first hook engaging portion of said fixing device will be biased away from said first substantially planar member of said fixing device.

24. The combination as set forth in claim 23, wherein:

said ramp portion comprises a sloped surface disposed opposite said first bearing surface of said first substantially planar member of said fixing device.

25. The combination as set forth in claim 13, wherein:

said fixing device has an elongated length; and a plurality of first hook engaging portions are disposed in a longitudinally spaced array along said fixing device.

26. The combination as set forth in claim 13, wherein:

said first and second members, and said first hook engaging portion, of said fixing device all have the same predetermined length.

27. A device for fixing a seat covering upon a seat, comprising:

first member having an exterior side;

a second member disposed substantially parallel to and spaced from said first member so as to define a recess between said first and second members for receiving a hook member of the seat;

hook engaging means, projecting outwardly from said second member and transversely with respect to said second member so as to extend toward said first member, for engaging a hook member of the seat when the hook member of the seat is disposed within said recess defined between said first and second members whereby the seat covering can be secured to the seat; and means disposed upon said first member for fixedly securing the seat covering upon said first member in such a manner that when the seat covering is secured upon said first member, said first member is covered by the seat covering and is not visible.

28. The device as set forth in claim 27, wherein:

said means for fixedly securing the seat covering upon said first member comprises a coplanar extended portion of said first member to which a free end portion of the seat covering can be secured.

29. The device as set forth in claim 28, further comprising:

a transversely disposed member interconnecting said first and second members such that said first and second members, and said transversely disposed member, taken together, define said fixing device which has a substantially U-shaped configuration.

30. The device as set forth ion claim 29, wherein:

said second member of said fixing device, having said hook engaging means disposed thereon, is flexibly mounted upon said transversely disposed member of said fixing device so as to permit said hook engaging means of said second member to be moved away from said first member of said fixing device and thereby permit a hook member of a seat to be inserted into said recess of said fixing device.

31. The device as set forth in claim 29, wherein:

said hook engaging means of said second member comprises a ramp portion for engaging a hook member of a seat whereby, as a result of the hook member of the seat encountering said ramp portion of second member of said fixing device, said hook engaging means of said second member of said fixing device will be biased away from first member of said fixing device so as to permit the hook member of the seat to enter said recess of said fixing device.

32. The device as set forth in claim 29, wherein:

said transversely disposed member of fixing device is connected to said fixing device at a point between first member of said fixing device and said coplanar extended portion of said first member of said fixing device.

33. A method of fixing a seat covering upon a seat, comprising the steps of:

providing a fixing device, for securing a seat covering upon a seat, having a first member comprising a first interior surface and a second exterior surface; a second member disposed substantially parallel to and spaced from said first member so as to define a recess between said first and second members for receiving a hook member of the seat; and a hook engaging means, projecting outwardly from said second member and transversely with respect to said second member so as to extend toward said interior surface of said first member, for engaging hook member of the seat when the hook member of the seat is disposed within said recess;

securing an edge portion of a seat covering to said interior surface of said first member; and wrapping said seat covering around an edge portion of said first member, defined between said first and second interior and exterior surfaces, such that said seat covering encases said first member, whereby when said fixing device is mounted upon the seat as a result of said hook engaging means engaging the hook member of the seat, said first member is covered by said seat covering and said exterior surface is not visible.

* * * * *